US005605127A

United States Patent [19]

Yoshihara et al.

[11] Patent Number: 5,605,127

[45] Date of Patent: Feb. 25, 1997

[54] CYLINDER COVER FOR DIESEL ENGINE

[75] Inventors: Sadao Yoshihara; Masahiko Okabe; Tooru Nakamura; Katsuhiko Sakaguchi; Nobuyuki Kunihiro, all of Kobe, Japan

[73] Assignee: Mitsubishi Jukogyo Kabushiki Kaisha, Tokyo, Japan

[21] Appl. No.: 449,730

[22] Filed: May 25, 1995

[30] Foreign Application Priority Data

May 27, 1994 [JP] Japan ..... 6-136645

[51] Int. Cl.[6] ..... F02B 3/00

[52] U.S. Cl. ..... 123/299; 123/305

[58] Field of Search ..... 123/299, 305, 123/470, 300–301, 193.5, 193.3

[56] References Cited

U.S. PATENT DOCUMENTS

| | | | |
|---|---|---|---|
| 1,679,743 | 8/1928 | Riehm | 123/301 |
| 1,767,701 | 6/1930 | Riehm | 123/301 |
| 2,606,538 | 8/1952 | Malin | 123/301 |
| 2,627,254 | 2/1953 | Juhasz | 123/301 |
| 2,628,600 | 2/1953 | Malin | 123/301 |
| 2,700,964 | 2/1955 | Nallinger | 123/193.3 |
| 2,768,615 | 10/1956 | Taylor et al. | 123/305 |
| 3,326,191 | 6/1967 | Berlyn et al. . | |
| 3,924,598 | 12/1975 | Davis | 123/305 |
| 4,106,702 | 8/1978 | Gardner et al. | 239/533.3 |
| 4,140,088 | 2/1979 | de Vulpillieres | 123/299 |
| 4,582,028 | 4/1986 | Wagner et al. | 123/193.3 |
| 4,612,898 | 9/1986 | Steiger et al. | 123/299 |
| 4,858,579 | 8/1989 | Elsbett et al. | 123/305 |
| 4,987,887 | 1/1991 | Kelly . | |
| 5,060,610 | 10/1991 | Paro | 123/305 |
| 5,095,868 | 3/1992 | Brighigna | 123/193.5 |

FOREIGN PATENT DOCUMENTS

| | | |
|---|---|---|
| 2-16360 | 1/1990 | Japan . |
| 3-179163 | 8/1991 | Japan . |
| 4-66720 | 3/1992 | Japan . |
| 6-137229 | 5/1994 | Japan . |
| 00141 | of 1913 | United Kingdom . |
| 247778 | 2/1926 | United Kingdom . |

OTHER PUBLICATIONS

Internal Combustion Engine, Huang Kai Li, Zheng Wen Publication Co. Ltd., Aug. 1985, pp. 108–111.

*Primary Examiner*—Thomas N. Moulis

*Attorney, Agent, or Firm*—Birch, Stewart, Kolasch & Birch, LLP.

[57] ABSTRACT

Objects of a cylinder cover for diesel engine is to prevent the interference of mists between a plurality of fuel valves, thereby enhancing the spray efficiency, and to prevent troubles of burning of nozzle caused by the collision of mist sprayed from the adjacent fuel valve and increase in thermal stress caused by local overheat of combustion chamber surface due to the collision of mist. To achieve these objects, fuel valves are mounted in a side wall of the cylinder cover so that the centerline thereof is substantially at right angles to the cylinder centerline. Further, the injection angle of the fuel valve is set so as to be an acute angle not larger than 90° to prevent local collision of mist with the combustion chamber wall surfaces, and the volume of the volume portion at the tip of the fuel valve is decreased to the minimum.

3 Claims, 12 Drawing Sheets

CYLINDER COVER FOR DIESEL ENGINE

FIELD OF THE INVENTION AND RELATED ART STATEMENT

The present invention relates to a mounting construction of a fuel valve of a cylinder cover for a diesel engine, particularly for a large diesel engine.

Large diesel engines are often provided with a plurality of fuel valves arranged in the circumferential direction of a cylinder cover to facilitate the diffusion of fuel mist in a combustion chamber.

FIGS. 11 to 13 show an example of a conventional mounting construction of a fuel valve of a cylinder cover for a large diesel engine. In FIG. 11, reference numeral 1 denotes a fuel valve mounted in an upper wall 2*a* of the cylinder cover 2, 3 denotes a piston, 4 denotes a cylinder liner, 5 denotes an exhaust valve casing, and 6 denotes a combustion chamber.

In the above-described diesel engine, the fuel valve 1 is mounted in a mounting hole formed in the upper wall 2*a* of the cylinder cover 2 so that the centerline la of the fuel valve 1 is usually in substantially parallel with the cylinder centerline Z as shown in FIG. 11. If the fuel valve is mounted in an inclined manner, the mounting angle, that is, the angle $\alpha$ formed between the centerline 1*a* of the fuel valve 1 and the cylinder centerline Z is not larger than 45° .

Therefore, the conventional cylinder cover presents the following problems:

(1) when a plurality of fuel valves 1-1, 1-2, 1-3, . . . are mounted around the circumference of pitch circle $D_1$ of the cylinder cover 2, as shown in FIGS. 12 and 13, for example, the mist injected from the first fuel valve 1-1 reaches the nozzle tip of the second fuel valve 1-2, so that the nozzle tip of the second fuel valve 1-2 is burnt by the combustion of mist. This trouble occurs at the third fuel valve 1-3 and the first fuel valve 1-1 as well as shown in FIG. 13.

(2) If the circumferential distance between the fuel valves 1-1, 1-2, and 1-3 is increased to avoid the occurrence of the above trouble, the number of fuel valves to prevent interference in mist is two or less. However, if the number of the fuel valves 1 decreases, the quantity of injection per fuel valve increases, so that the spray efficiency such as atomizing force and penetrating force of mist is lowered.

FIGS. 14 and 15 shows the details of the conventional fuel valve 1 described above. In these figures, 1*b* denotes a fuel valve body, if denotes a nozzle, 1*c* denotes a nozzle hole formed at the tip end of the nozzle 1*f*, 1*d* denotes a needle valve fitted slidably into the nozzle 1*f*, and 1*e* denotes a picker for the needle valve. In this example, the nozzle hole 1*c* is formed at two stages at the tip of the nozzle if as shown in FIG. 15, and the injection angle K thereof is set so as to be an obtuse angle of about 120°.

However, in the conventional cylinder cover for diesel engine described above, which has the fuel valves 1 mounted in the upper wall 2*a* of the cylinder cover 2, in order to spray fuel uniformly into the combustion chamber 6, a considerable length $L_1$ of the tip end of the fuel valve 1-1 must be protruded into the combustion chamber 6 as shown in FIG. 12 so that fuel is sprayed from the nozzle holes (refer to FIGS. 14 and 15) formed at the tip side of the nozzle.

OBJECT AND SUMMARY OF THE INVENTION

An object of the present invention is to provide a cylinder cover for diesel engine which prevents the interference of mists between a plurality of fuel valves, thereby improving the spray efficiency, and prevents troubles of burning of nozzle caused by the collision of mist sprayed from the adjacent fuel valve and increase in thermal stress caused by local overheat of combustion chamber surface due to the collision of mist.

The present invention solves the above problems step by step by the following means:

(1) A plurality of fuel valves are mounted in a side wall of a cylinder cover. The distance between the fuel valves in the circumferential direction is increased to preclude interference with the mist sprayed from the adjacent fuel valve, and the number of fuel valves being mounted is increased.

(2) When the fuel valves are mounted in the side wall of the cylinder cover as described in item (1), the problems described below must be solved.

(2-1) For the conventional fuel valve, the injection angle K of a nozzle hole is usually set so as to be an obtuse angle of about 120° as shown in FIGS. 14 and 15. In this case, as shown in FIGS. 11 and 12, if the fuel valves 1 are mounted in an upper wall 2*a* of the cylinder cover 2, sufficient width $J_1$ of a combustion chamber can be provided, so that the spread of mist in the direction perpendicular to the cylinder centerline Z can be obtained. Therefore, there is no problem in terms of combustion.

However, when the fuel valve is mounted in the side wall of the cylinder cover as defined in claims 1 and 2, the space where the mist reaches is wide (length $J_2$) in the direction of the fuel valve centerline 10*a*, and narrow (length $H_2$) in the direction of the cylinder centerline (Z) as shown in FIG. 2.

Since the combustion chamber has such a construction, when a fuel valve having a large injection angle K (an obtuse angle of about 120° ) as shown in FIGS. 14 and 15 is used, the following problems occur.

(a) The mist collides with the upper and lower surfaces of the combustion chamber (the lower surface of the cylinder cover and the upper surface of the piston), so that the temperature of the collision surfaces, that is, the lower surface of the cylinder cover 1 and the upper surface of the piston 3 increases excessively, resulting in burning of the cylinder cover and the piston.

(b) The atomization of mist is inhibited, by which the combustion is worsened.

(2-2) In the fuel valve, a nozzle hole 1*c* mis open to a volume portion 1*i* formed by a cylindrical portion 1*g* (length W) and a spherical portion 1*h* (length X) as shown in FIG. 15.

When the volume portion 1*i* is large, the injection pressure is decreased, so that the mist is not injected efficiently into the combustion chamber 6.

Thereupon, if the amount of fuel remaining in the volume portion 1*i* is large, dripping of fuel occurs into the combustion chamber 6 after the injection is completed, which causes the reduction in fuel consumption.

Contrarily, if the volume portion 1*i* is decreased, the nozzle holes 1*c* come close to each other, and finally the adjacent nozzle holes are joined together. Therefore, the reduction in the volume portion 1*i* is limited.

(2-3) The present invention solves the above problems by configuring the fuel valve as described above in the cylinder cover having fuel valves mounted in the side wall thereof (refer to FIGS. 1 to 10).

(a) The injection angle of the nozzle hole of the fuel valve is set so as to be not larger than 45° with respect to the nozzle centerline so that the collision of mist with the lower surface of the cylinder cover and the upper surface of the piston is inhibited while the penetrating force of mist is maintained.

(b) The center of the nozzle hole of the fuel valve is displaced by a certain amount with respect to the nozzle centerline.

(c) The spherical surface 10*h* of the fuel valve defining the volume portion 10*i* between the needle valve seat portion S of nozzle and the nozzle hole is formed so as to be adjacent to a small-diameter portion d of the seat portion and smaller than the hemisphere with a diameter of d.

(d) The nozzle hole of the fuel valve has a nozzle inside opening on the spherical surface 10*h* and a combustion chamber side opening on a nozzle tip curved surface 10*j*.

Since the present invention is configured as described above, the pitch circle diameter $D_2$ of the fuel valve nozzle hole in the cylinder cover for an engine with the same cylinder diameter can be made larger than the conventional pitch diameter $D_1$, so that the distance between adjacent fuel valves increases, by which the interference of mists between the fuel valves can be inhibited.

Accordingly, a larger number of fuel valves can be used, so that the spray efficiency can be enhanced, and the trouble of burning of a fuel valve tip caused by the collision of mist sprayed from the adjacent fuel valve can be avoided.

Also, the fuel valve is mounted in the side wall of the cylinder cover so that the injection angle is not larger than (45°×2). Therefore, the collision of mist sprayed from the fuel valve with the lower surface of the cylinder cover and the upper surface of the piston can be prevented.

Further, the nozzle hole is open on the spherical surface outside the needle valve seat portion on the inside of the nozzle, and the volume of the volume portion between the needle valve seat portion and the nozzle hole is formed sufficiently small. Therefore, after-dripping of mist after injection is prevented, and the injection is finished fully.

DETAILED DESCRIPTION OF PREFERRED EMBODIMENTS

The embodiment of the present invention will be described in detail with reference to FIGS. 1 to 10.

Figure 1:
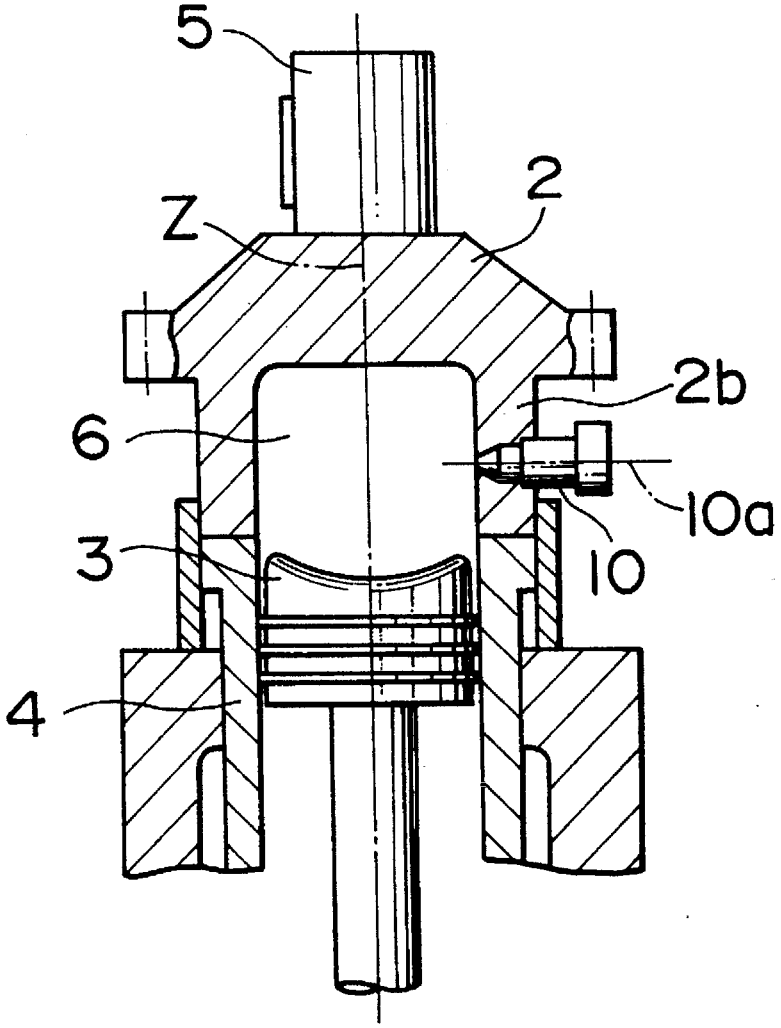
FIG. 1 is a sectional view along the cylinder centerline, showing a fuel valve mounting portion of a cylinder cover in accordance with the embodiment of the present invention.
Figure 2:
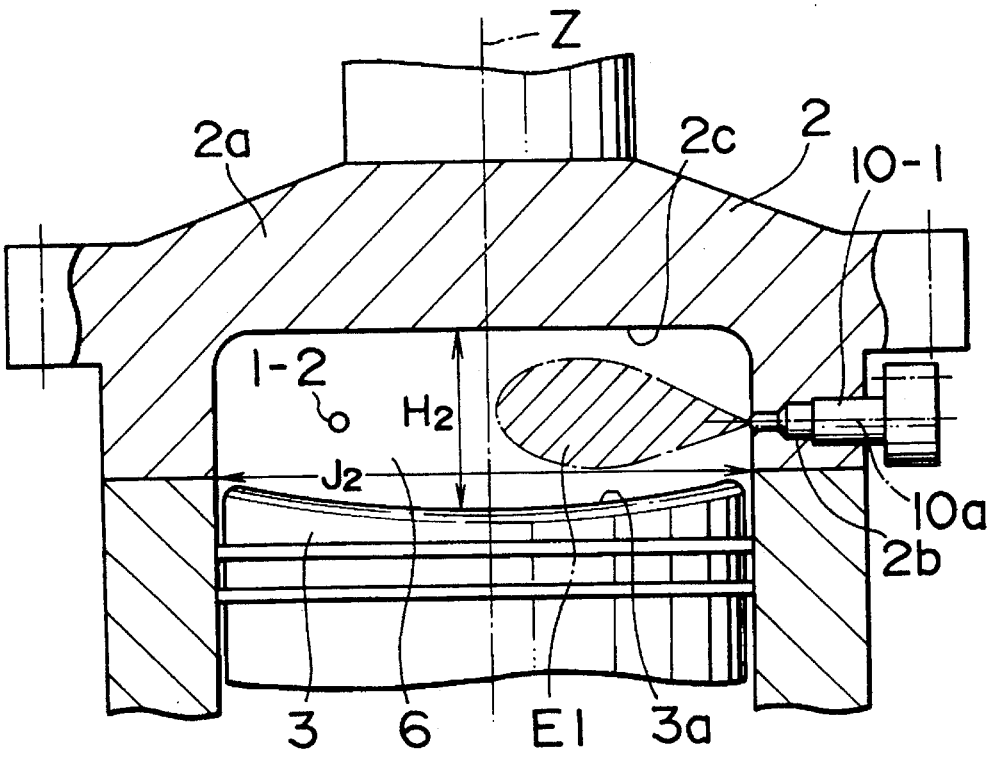
FIG. 2 is an enlarged sectional view of the principal part of FIG. 1.
Figure 3:
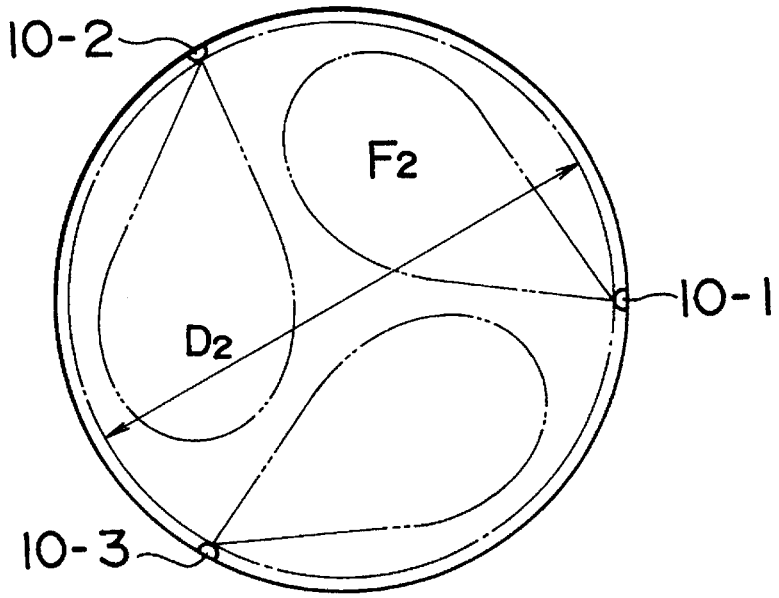
FIG. 3 is a schematic view for illustrating the state of mist in the above embodiment.

FIG. 1 is a sectional view along the cylinder centerline, showing a fuel valve mounting construction of a cylinder cover in accordance with the embodiment of the present invention, FIG. 2 is an enlarged sectional view o#the principal part of FIG. 1, and FIG. 3 is a schematic plan view showing the diffusion state of fuel mist.

Referring to FIG. 1, a fuel valve 10 is mounted in a side wall 2*b* of a cylinder cover 2 so that the centerline 10*a* thereof is substantially at right angles to the cylinder centerline Z. In this embodiment, three fuel valves 10 are arranged at equal intervals in the circumferential direction of the cylinder cover 2, but the number of fuel valves is not limited to three, and more fuel valves may be used.

Reference numeral 3 denotes a piston, 4 denotes a cylinder liner, 5 denotes an exhaust valve casing, and 6 denotes a combustion chamber. In FIG. 2, $J_2$ represents the maximum length of the combustion chamber 6 along the direction of the centerline 10*a* of the fuel valves 10-1, 10-2, and 10-3, and $H_2$ represents the height of the combustion chamber 6 in the mist width direction at the time when fuel is injected.

Figure 4:
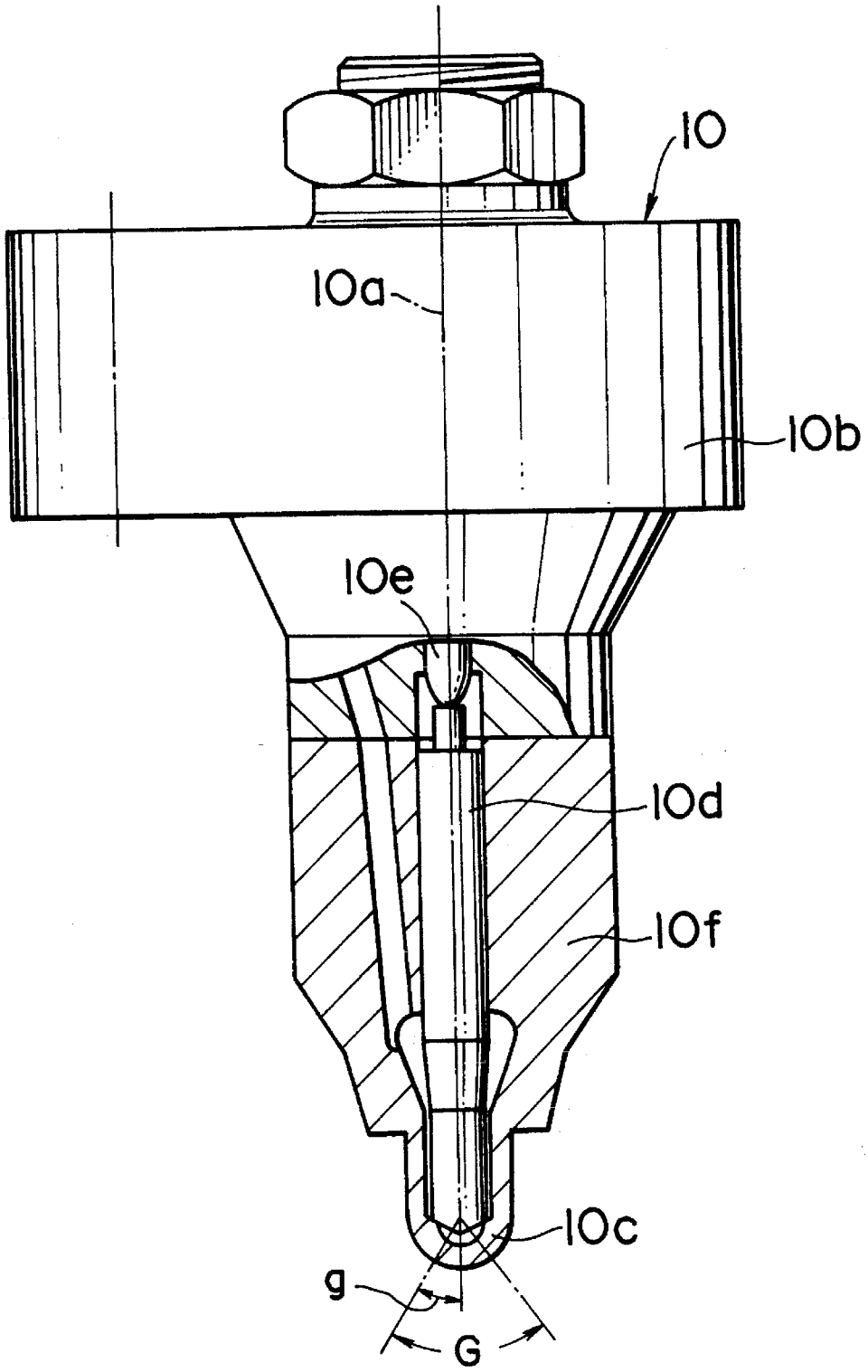
FIG. 4 is a sectional view of the principal part of a fuel injection valve in accordance with the above embodiment.

FIG. 4 shows the construction of the fuel valve 10 mounted in the side wall 2*b* of the aforementioned cylinder cover. In this figure, 10*b* denotes a fuel valve body, 10*f* denotes a nozzle, 10*c* denotes a plurality of nozzle holes formed at the tip end of the nozzle 10*f*, 10*d* denotes a needle valve, and 10*e* denotes a picker for the needle valve.

The injection angle G of the nozzle hole 10*c* is set so as to be an acute angle not larger than 90° (not larger than 45° with respect to the nozzle centerline 10*a*).

In the diesel engine having the fuel valve mounting construction of the cylinder cover configured as described above, as shown in FIG. 2, the fuel mist $E_1$ sprayed from the fuel valve 10-1 mounted in the side wall 2*b* of the cylinder cover 2 is diffused sufficiently in the combustion chamber 6 along the direction of the centerline 10*a* of the fuel valve 10-1 because the distance $J_2$ in the combustion chamber 6 is long.

Moreover, since the injection angle G of the nozzle hole of the fuel valve 10-1 is so small that G/2 is not larger than 45° as shown in FIG. 4, the mist does not collide with the lower surface 2*c* of the cylinder cover 2 and the upper surface 3*a* of the piston 3.

Figure 13:
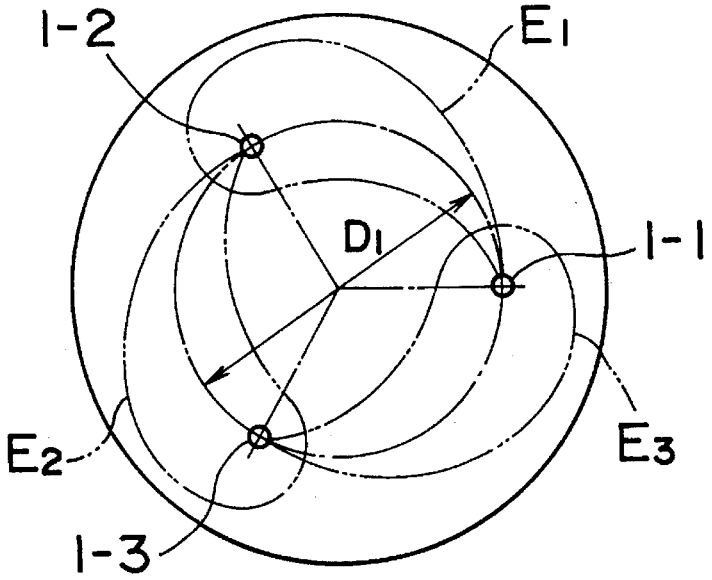
FIG. 13 is a view showing a conventional example corresponding to FIG. 3.
Figure 14:
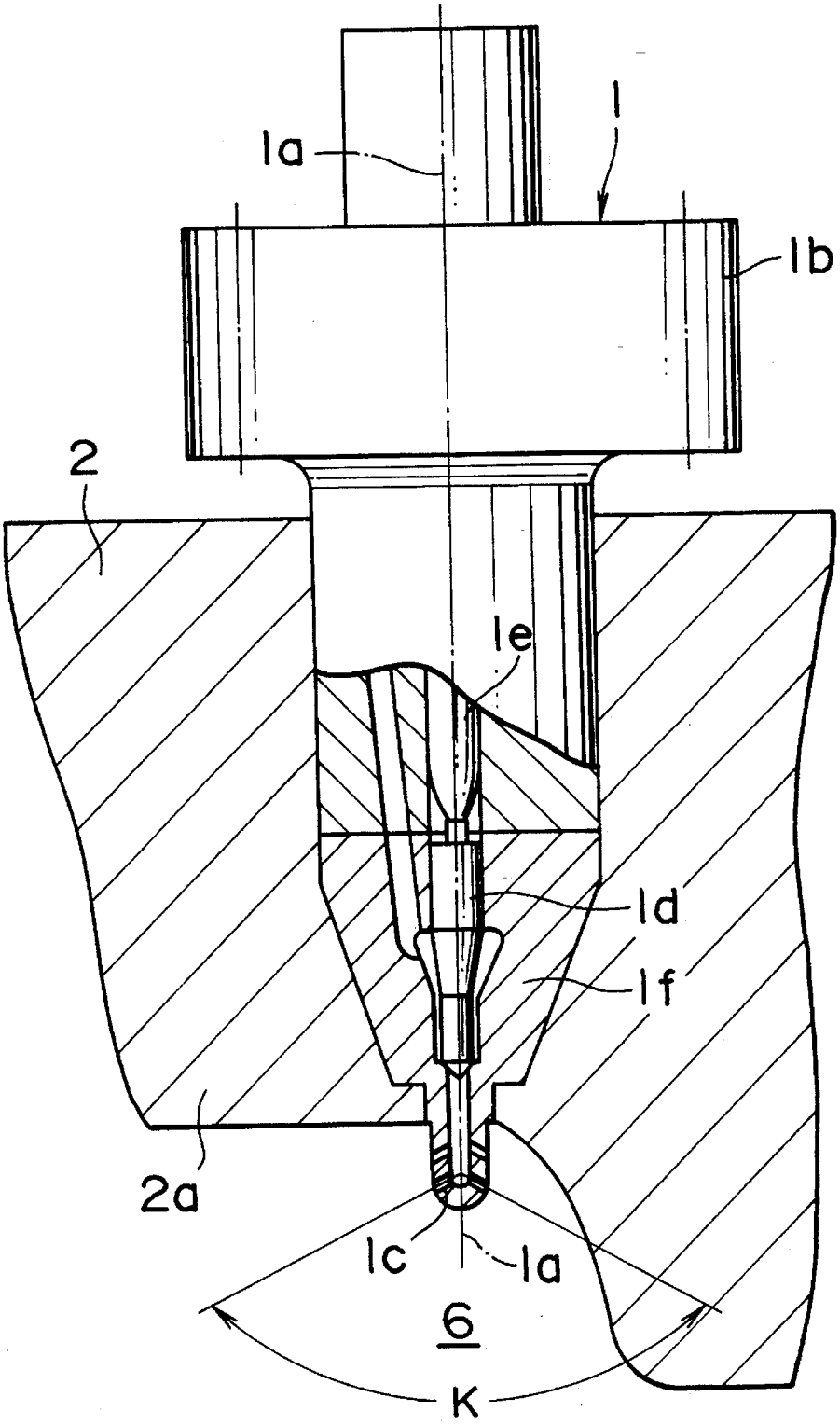
FIG. 14 is a sectional view of the principal part showing one example of a conventional fuel valve.
Figure 15:
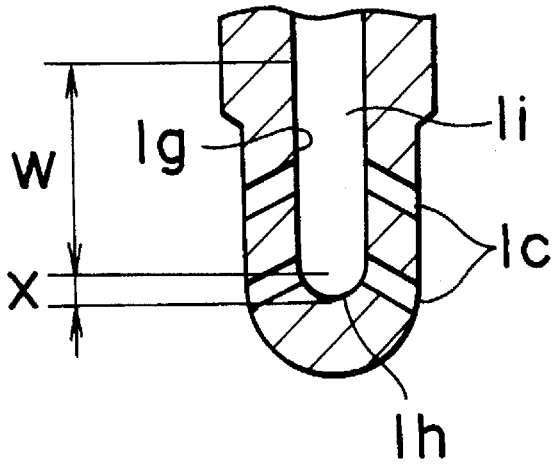
FIG. 15 RELATED ART
FIG. 15 is an enlarged view of FIG. 14.

FIG. 3 shows the diffusion state of mists in the horizontal direction in this embodiment. The fuel valves 10-1, 10-2, and 10-3 are mounted in the side wall 2*b* of the cylinder cover 2 at equal intervals in the circumferential direction on the pitch circle $D_2$ of the nozzle hole 10*c*. The distance between the fuel valves 10-1, 10-2, and 10-3 in the circumferential direction is longer than the distance (pitch circle $D_1$) in the conventional cylinder cover shown in FIG. 13. Therefore, the mist can be developed by widely using the space in the combustion chamber 6, the interference between mists can be prevented, and a mist in which atomization and penetrating force are well-balanced is provided.

FIGS. 5*a*, 5*b*, 6*a*, 6*b*, 7*a*, 7*b*, 8*a*, 8*b*, 9 and 10 show machining examples of nozzle holes 10*c* in the fuel valve 10 in accordance with the present invention. In this embodiment, four nozzle holes of 10*c*-1 (FIGS. 5*a* and 5*b*), 10*c*-2 (FIGS. 6*a* and 6*b*), 10*a*-3 (FIGS. 7*a* and 7*b*), and 10*c*-4 (FIGS. 8*a* and 8*b*) are machined in that sequence.

The nozzle holes 10*c*-1, 10*c*-2, 10*c*-3, and 10*c*-4 have an angle of $\beta_1$, $\beta_2$, $\beta_3$, and $\beta_4$, that is, an injection angle with respect to the centerline 10*a* of the nozzle 10*f* (i.e., centerline of fuel valve), respectively, and are displaced with an eccentricity of $1_1$, $1_2$, $1_3$, and $1_4$ with respect to the centerline

10*a*. Further, the nozzle holes are drilled from the tip curved surface 10*j* of the nozzle 10*f* toward a point in the space having a distance of $H_1$, $H_2$, $H_3$, and $H_4$ from the tip end of the nozzle 10*f*.

At this time, the nozzle holes 10*c*-1 to 10*c*-4 are drilled from the tip curved surface 10*j* of the nozzle 10*f* so that an opening is formed on a spherical surface 10h of a volume portion. The injection angles $\beta_1$ to $\beta_4$ are set so as to be not larger than 45° with respect to the nozzle centerline 10*a* (fuel valve centerline).

To meet the above-described requirements for machining and function, the fuel valve in accordance with the present invention has the construction and features described below.

Figure 5B:
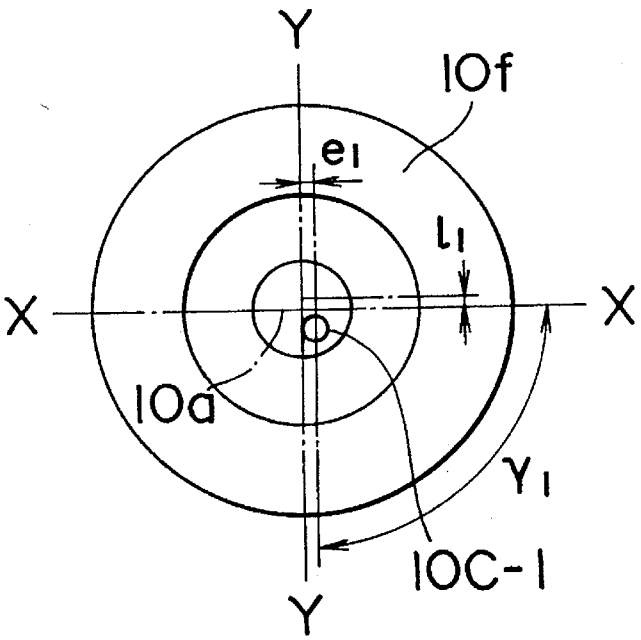
FIGS. 5*a*, 5*b*, 6*a*, 6*b*, 7*a*, 7*b*, 8*a* and 8*b* are machining instruction views for nozzle holes at the tip of nozzle in the above embodiment.
Figure 5A:
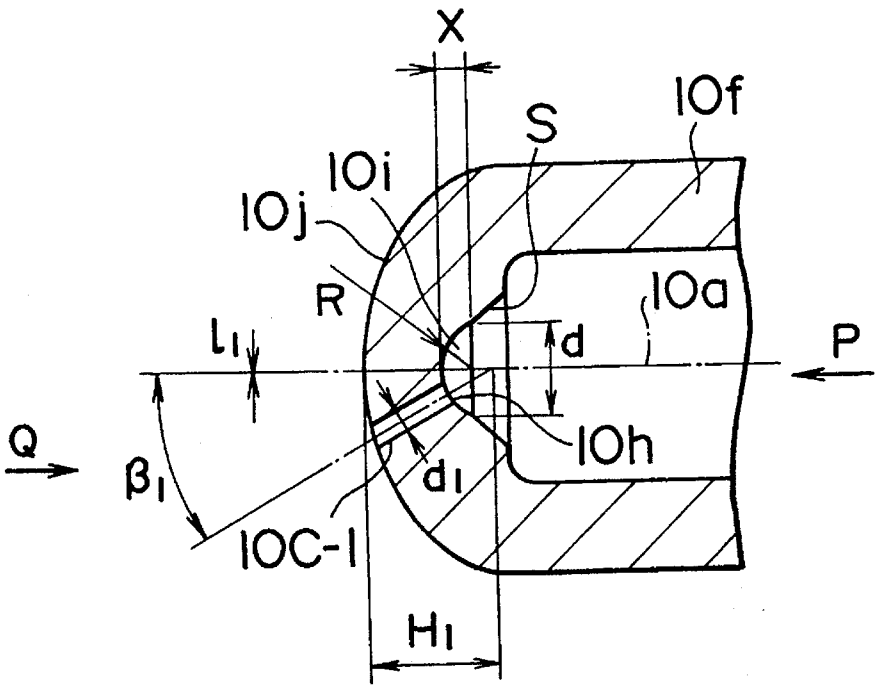
Figure 6B:
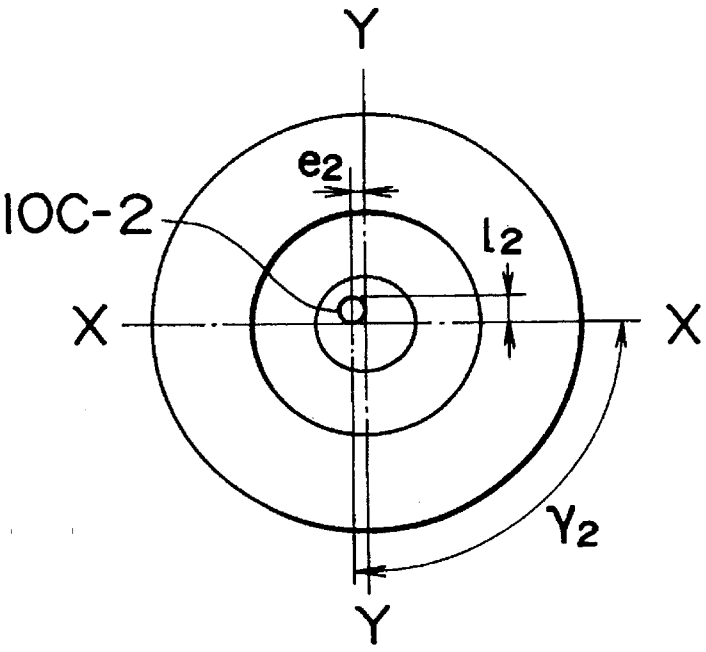
Figure 6A:
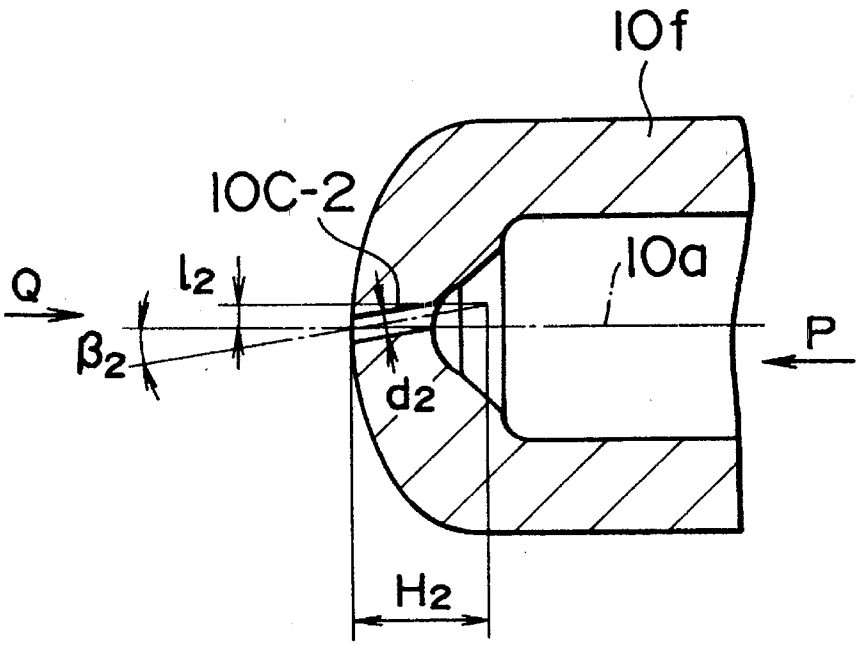
Figure 7B:
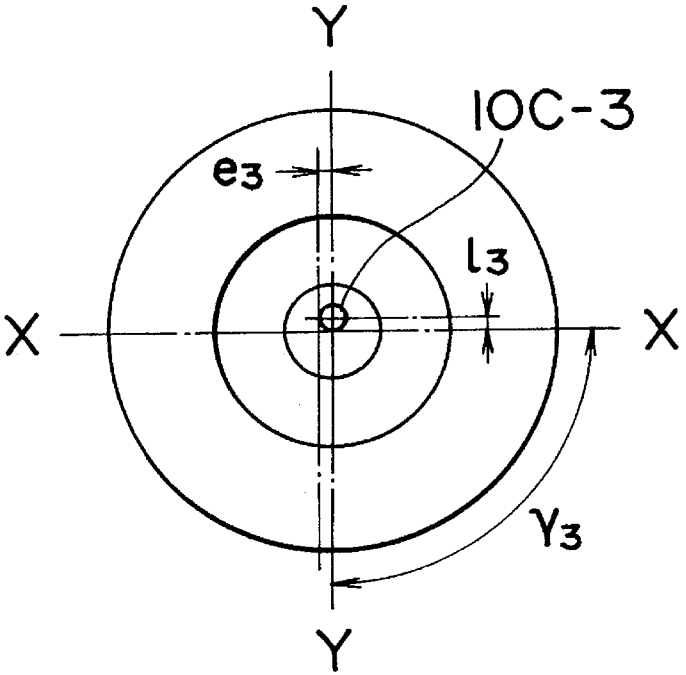
Figure 7A:
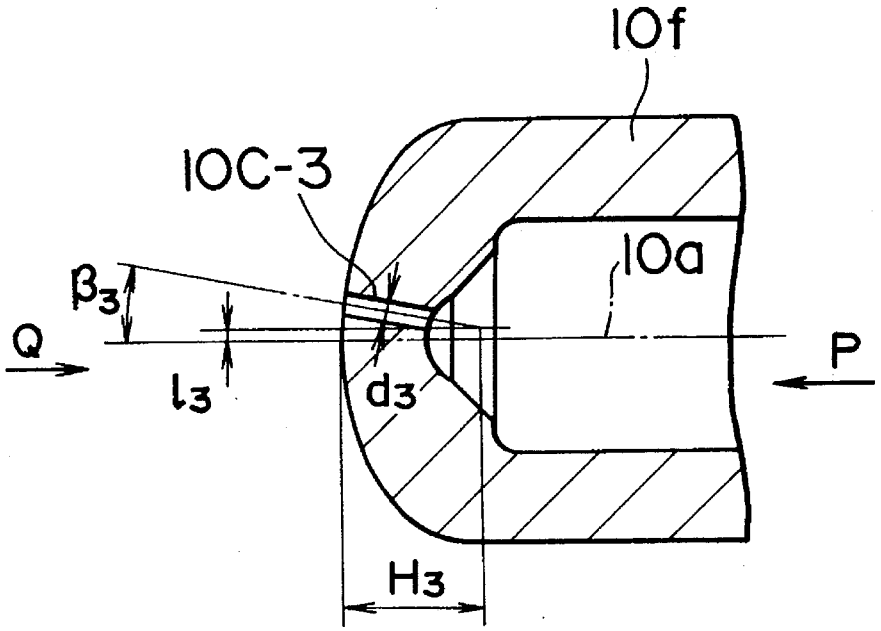
Figure 8B:
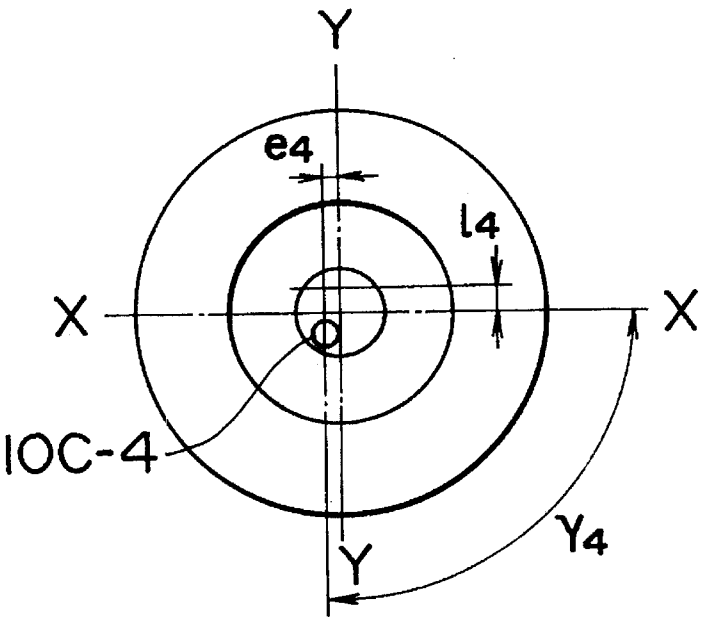
Figure 8A:
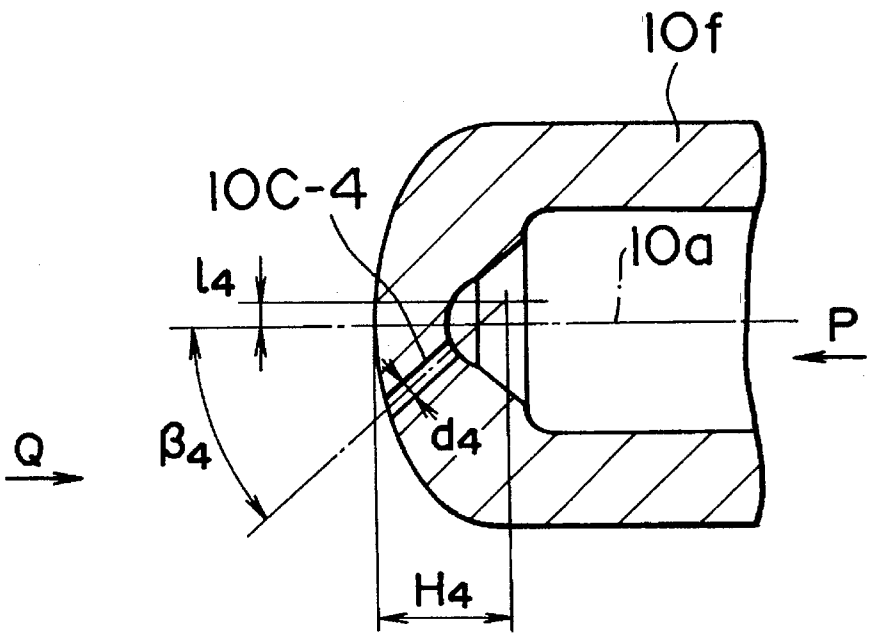

As shown in FIG. 5*a* and 5*b*, a seat portion S for the needle valve 10*d* (refer to FIG. 4) for controlling the injection of fuel from the nozzle 10*f* is provided close to the nozzle tip. Further, the spherical surface 10*h* having a radius R which is not more than ½ of the small diameter d of the seat portion S is provided close to the seat portion S. Thereupon, the volume portion 10*i* is formed by the spherical surface portion 10*h* (length X) only, so that the volume portion 10*i* can be minimized.

FIGS. 5*b*, 6*b*, 7*b*, and 8*b* show plan views (viewed in the P direction in each figure) of the inside surface of the nozzle 10*f*. As seen from these figures, four nozzle holes 10*c*-1, 10*c*-2, 10*c*-3, and 10*c*-4 are formed with a rotation angle of $\gamma_1$, $\gamma_2$, $\gamma_3$, and $\gamma_4$ and an eccentricity of $e_1$, $e_2$, $e_3$, and $e_4$ with respect to the X-X axis and the Y-Y axis passing through the nozzle center 10*a*, respectively, in addition to the position in the above-described longitudinal sectional direction.

Figure 9:
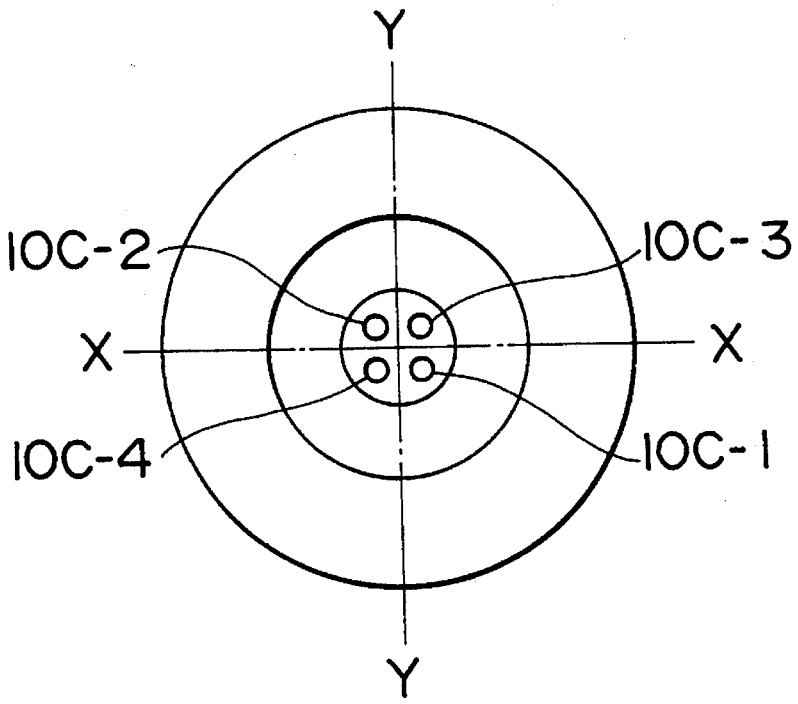
FIGS. 9 and 10 are arrangement views of nozzle holes in the above embodiment.
Figure 10:
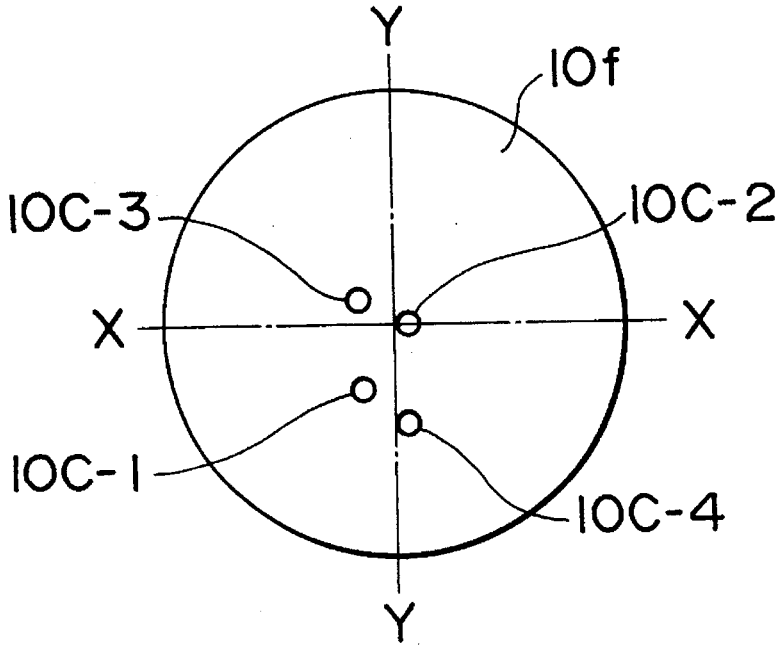
Figure 11:
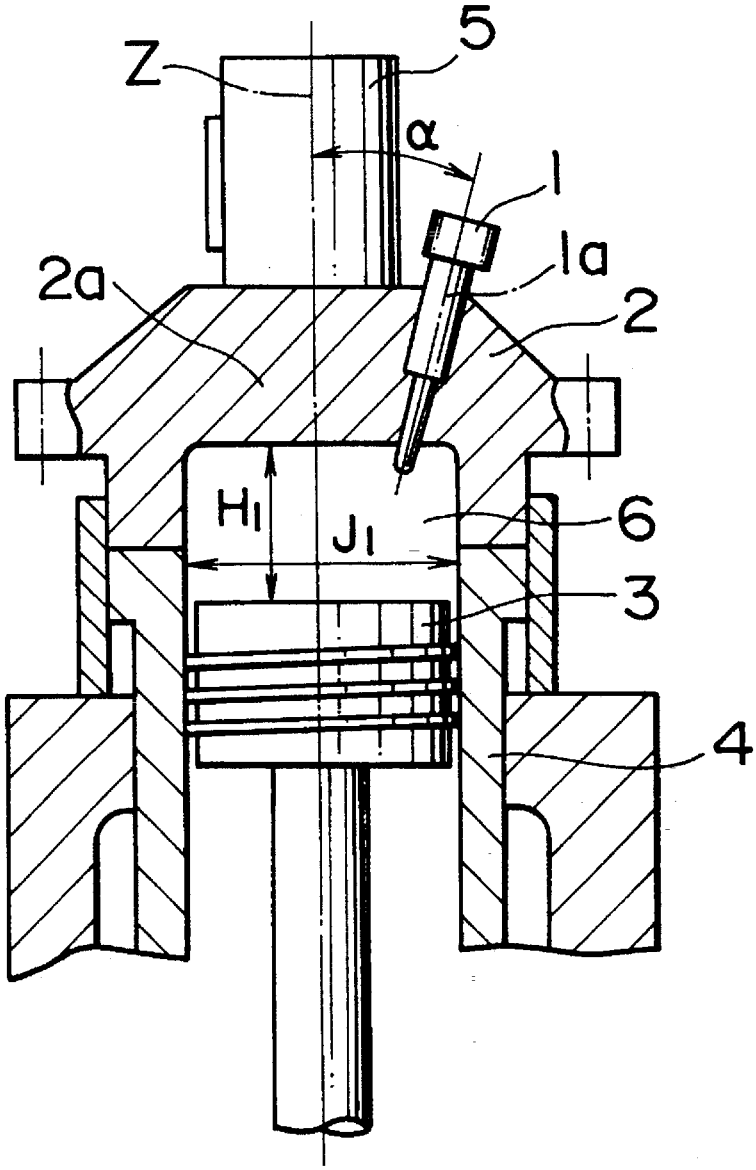
FIG. 11 RELATED ART
FIG. 11 is a view showing a conventional example corresponding to FIG. 1.
Figure 12:
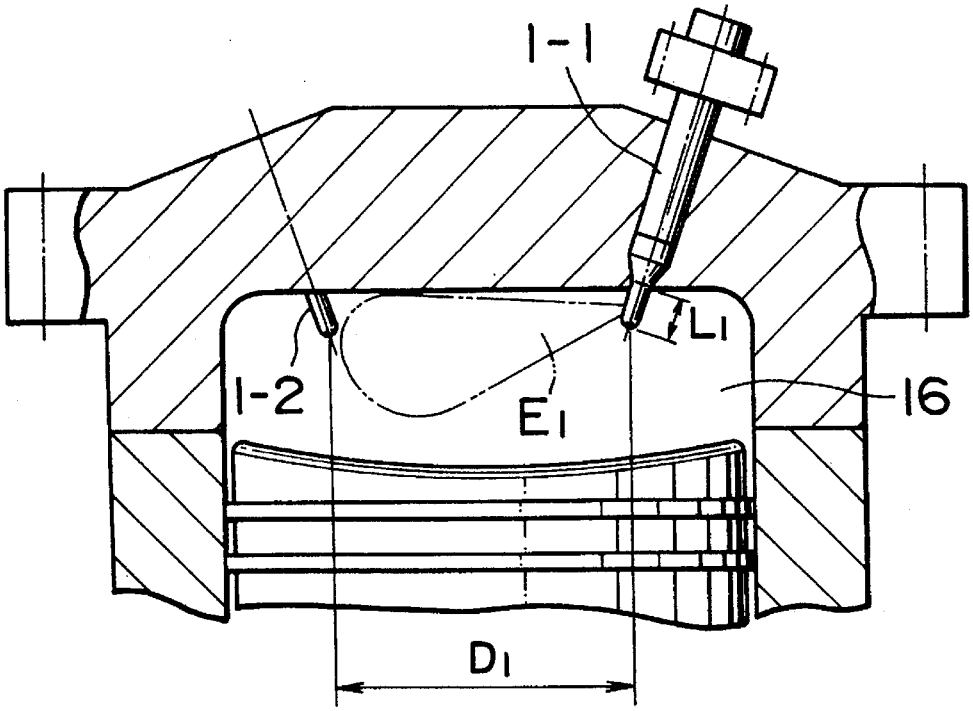
FIG. 12 is a view showing a conventional example corresponding to FIG. 2.

The nozzle holes 10*c*-1, 10*c*-2, 10*c*-3, and 10*c*-4 configured as described above are formed so that all the holes are open on the spherical surface 10*h* on the inside (the side viewed in the P direction in FIGS. 5*a*, 5*b*, 6*a*, 6*b*, 7*a*, 7*b*, 8*a* and 8*b*) of the nozzle 10*f* as shown in FIG. 9. 0n the outside (the side viewed in the Q direction in FIGS. 5*a*, 5*b*, 6*a*, 6*b*, 7*a*, 7*b*, 8*a* to 8*b* of the nozzle 10*f* , the nozzle holes are formed so that the holes are open on the tip curved surface 10*j* of the nozzle 10*f*.

Since the present invention is configured as described above, according to the invention defined in claims 1 and 2, a plurality of fuel valves are mounted in the side wall of the cylinder cover, so that the fuel mist sprayed from one fuel valve does not interfere with the mist from the adjacent fuel valve, by which uniform spray is provided and the spray efficiency is increased.

Also, a large diffusion space for the mist from the fuel valve can be provided in the combustion chamber, so that a mist in which the atomization and the penetrating force of mist are well-balanced can be obtained.

Further, the mist from one fuel valve is less prone to collide with the tip of another fuel valve, so that the burning of nozzle tip caused by the collision of mist sprayed from the adjacent fuel valve can be prevented.

In the invention defined in claim 3, the fuel valve is mounted in the side wall of the cylinder cover so that the injection angle is set so as to be an acute angle not larger than (45°×2), so that the vertical (in the direction of the cylinder centerline) spread of mist from the fuel valve is inhibited and the spread in the fuel valve centerline direction is promoted. Therefore, the collision of mist with the lower surface of the cylinder cover and the upper surface of the piston is avoided, and the increase in temperature on the surfaces of the combustion chamber is prevented, whereby the durability of the engine is enhanced.

Still further, according to the invention defined in claims 4 to 6, the volume of the volume portion between the needle valve seat portion and the nozzle hole of the fuel valve can be decreased sufficiently, so that the occurrence of after-dripping of mist can be prevented and the spraying is finished fully, whereby fuel can efficiently be injected into the combustion chamber. As a result, the fuel consumption can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. In a diesel engine in which a plurality of fuel valves are mounted in a cylinder cover to directly inject fuel into a combustion chamber, a cylinder cover wherein said plural fuel valves are mounted in a side wall of said cylinder cover so that said plural fuel valves are arranged in the circumferential direction about said side wall and the centerline of each of said plural fuel valves is substantially at right angles to the cylinder centerline, wherein one of said fuel valves includes a needle valve seat portion (S) and a spherical surface (10*h*) which define a volume portion (10*i*) therebetween and a nozzle hole is formed so as to be adjacent to a small-diameter portion (d) of said seat portion and smaller than a hemisphere with a diameter of d.

2. In a diesel engine in which a plurality of fuel valves are mounted in a cylinder cover to directly inject fuel into a combustion chamber, a cylinder cover wherein said plural fuel valves are mounted in a side wall of said cylinder cover so that said plural fuel valves are arranged in the circumferential direction about said side wall and the centerline of each of said plural fuel valves is substantially at right angles to the cylinder centerline, wherein said plural fuel valves are mounted substantially at equal intervals in the circumferential direction, and said fuel valves include a needle valve seat portion (S) and a spherical surface (10*h*) which define a volume portion (10*i*) therebetween and a nozzle hole is formed so as to be adjacent to a small-diameter portion (d) of said seat portion and smaller than a hemisphere with a diameter of d.

3. In a diesel engine in which a plurality of fuel valves are mounted in a cylinder cover to directly inject fuel into a combustion chamber, a cylinder cover wherein said plural fuel valves are mounted in a side wall of said cylinder cover so that said plural fuel valves are arranged in the circumferential direction about said side wall and the centerline of each of said plural fuel valves is substantially at right angles to the cylinder centerline, wherein said plural fuel valves are mounted substantially at equal intervals in the circumferential direction, an injection angle of a nozzle hole of said plural fuel valves is set so as to be not larger than 45° with respect to the nozzle centerline, and said fuel valves include a needle valve seat portion (S) and a spherical surface (10*h*) which define a volume portion (10*i*) therebetween and a nozzle hole is formed so as to be adjacent to a small-diameter portion (d) of said seat portion and smaller than a hemisphere with a diameter of d.

* * * * *